US010443337B2

(12) United States Patent
Palmieri et al.

(10) Patent No.: US 10,443,337 B2
(45) Date of Patent: Oct. 15, 2019

(54) METAL TO METAL POLISHED BORE RECEPTACLE SEAL FOR LINER HANGER/SEAL ASSEMBLIES

(71) Applicant: BAKER HUGHES, A GE COMPANY, LLC, Houston, TX (US)

(72) Inventors: Abbie Palmieri, Houston, TX (US); Sidney K. Smith, Jr., Conroe, TX (US); James M. Fraser, Spring, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 435 days.

(21) Appl. No.: 14/950,616

(22) Filed: Nov. 24, 2015

(65) Prior Publication Data

US 2017/0145775 A1 May 25, 2017

(51) Int. Cl.

| | |
|---|---|
| ***E21B 33/12*** | (2006.01) |
| ***E21B 33/14*** | (2006.01) |
| ***E21B 43/10*** | (2006.01) |

(52) U.S. Cl.

CPC ..... *E21B 33/12* (2013.01); *E21B 33/1212* (2013.01); *E21B 33/14* (2013.01); *E21B 43/10* (2013.01)

(58) Field of Classification Search

CPC ..... E21B 33/12; E21B 33/1212; E21B 33/14; E21B 43/10; E21B 33/129

See application file for complete search history.

(56) References Cited

U.S. PATENT DOCUMENTS

| | | | | |
|---|---|---|---|---|
| 5,435,392 | A * | 7/1995 | Kennedy | E21B 23/002 166/117.5 |
| 5,662,341 | A | 9/1997 | Ezell et al. | |
| 2011/0036576 | A1* | 2/2011 | Schultz | E21B 36/02 166/303 |
| 2011/0147015 | A1 | 6/2011 | Mickey et al. | |
| 2014/0305662 | A1* | 10/2014 | Giroux | E21B 33/14 166/386 |

* cited by examiner

*Primary Examiner* — David J Bagnell
*Assistant Examiner* — Manuel C Portocarrero
(74) *Attorney, Agent, or Firm* — Shawn Hunter

(57) ABSTRACT

A liner string has a hanger/packer near its upper end for connection and sealing to a surrounding tubular. A polished bore assembly is located above the packer and is pushed down after the liner hanger is set to slide over a metal to metal seal on the packer body. A surface string is then tied into the polished bore with another metal to metal seal against the polished bore. The liner string has just metal to metal seals going up to the surface for well pressure containment. Elastomer seals to the polished bore are eliminated. Placement of the polished bore above the packer body allows for a larger diameter polished bore so as to minimize restriction to future production flow. The liner top packer seal is also metal to metal as offered by Baker Hughes Incorporated under the ZX trademark.

18 Claims, 1 Drawing Sheet

METAL TO METAL POLISHED BORE RECEPTACLE SEAL FOR LINER HANGER/SEAL ASSEMBLIES

FIELD OF THE INVENTION

The field of the invention is sealing systems for a liner hanger/packer assembly and more particularly where the polished bore is above the liner top packer and has a metal to metal seal to the packer body.

FIELD OF THE INVENTION

Boreholes are completed with a liner string connected to an existing string. Typically the liner string is run in with a running tool to the desired overlapping position with the existing string so that a liner hanger can be set and the running tool released. The hanger has spaces between the gripping members so that when cement is pumped through the liner and darts are launched to displace the cement out of a shoe at the lower end of the liner the fluid in the annulus can be displaced through those spaces. After that the liner top packer is set.

In existing designs there is a polished bore receptacle associated with the liner top packer and the seal between the mandrel for the packer and the polished bore has in the past been one or more resilient elastomer o-rings. The polished bore has also been located below the liner top packer and a string to the surface known as a tieback string was extended into the polished bore receptacle and sealed with a metal to metal seal.

The elastomer seals over a long period of time can leak and the present invention addresses this issue in a liner hanger/packer application with a metal to metal seal to a polished bore from the packer mandrel. The tieback string connects to the same polished bore with a metal to metal seal so that from the liner string to the surface there are only metal to metal seals. The polished bore is also located uphole from the liner top packer so that the tieback string and the polished bore can have a larger diameter so as not to restrict production flow unduly. The prior design located the polished bore below the packer seal which caused a flow restriction. These and other aspects of the present invention will become more readily apparent to those skilled in the art from a review of the description of the preferred embodiment and the associated drawings while recognizing that the full scope of the invention is to be determined from the appended claims.

Generally related to polished seal bores and/or metal to metal seals are U.S. Pat. No. 5,662,341 and US US20110147015.

SUMMARY OF THE INVENTION

A liner string has a hanger/packer near its upper end for connection and sealing to a surrounding tubular. A polished bore assembly is located above the packer and is pushed down after the liner hanger is set to slide over a metal to metal seal on the packer body. A surface string is then tied into the polished bore with another metal to metal seal against the polished bore. The liner string has just metal to metal seals going up to the surface for well pressure containment. Elastomer seals to the polished bore are eliminated. Placement of the polished bore above the packer body allows for a larger diameter polished bore so as to minimize restriction to future production flow. The liner top packer seal is also metal to metal as offered by Baker Hughes Incorporated under the ZX trademark.

DETAILED DESCRIPTION OF THE PREFERRED EMBODIMENT

Figure 1:
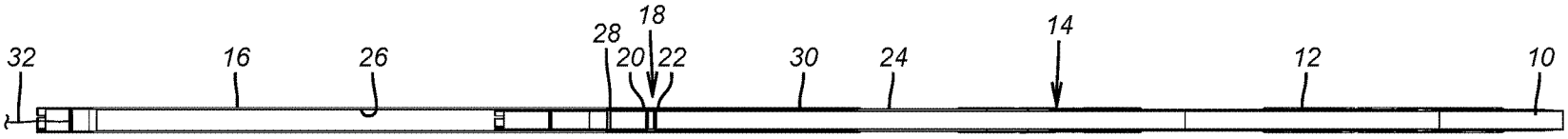
FIG. 1 is a section view of a liner top assembly in the run in position.
Figure 2:
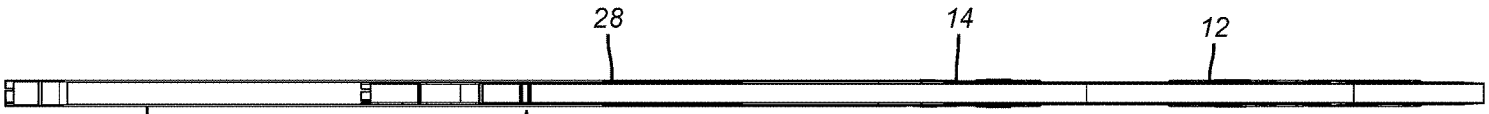
FIG. 2 is the view of FIG. 1 in the set position.

Referring to FIG. 1, a simplified liner string assembly is illustrated leaving out the running tool that is a well-known design. The purpose of the running tool is to position a liner string attached at 10 but not illustrated so that the liner hanger 12 and the liner top packer assembly 14 can be properly positioned opposite a lower end of an existing string that is also not shown. The liner hanger 12 is a known construction as is the liner top packer that can be a unit sold by Baker Hughes Incorporated under the trademark ZX®. Typically this seal has a metal to metal element that is pushed up a ramp against the opposing tubular after a cement job is completed. There is also an associated slip system to retain the set position of the liner top packer assembly 14. A polished bore assembly 16 is initially mounted above the liner top packer 14 as well as metal to metal seal 18. Seal 18 is basically a sleeve threaded to the mandrel 24 for the packer 14 to become an integral part of the mandrel 24 at the upper end 20 and the lower end 22 the dimension is enlarged such that on movement of seal bore 16 to the set position, there is a clearance or interference metal to metal contract between the ends 20 and 22 and the polished bore 26 of the assembly 16. It should be noted that there is no initial contact to bore 26 by ends 20 and 22 as the lower end 28 of the assembly 16 is still above upper end 20. Connected to the lower end 28 is setting sleeve 30 whose axial movement will set the liner top packer assembly 14 while shifting assembly 16 to the FIG. 2 position so that lower end 28 of assembly 16 has crossed over ends 20 and 22 for a metal to metal seal between mandrel 24 and assembly 16. This sequence of movements occurs as the liner hanger 12 is set by movement of setting sleeve 30 in tandem with assembly 16. Not shown is the running string that releases from mandrel 24 as these movements take place. What then takes place is a standard cement job through the running string followed by a pressure on a seated ball in the running string to set the liner hanger 12.

Several features are different than past designs and bear some emphasis. First there are no elastomer seals between the mandrel 24 and the assembly 16. The location of the assembly 16 uphole from the liner top packer 14 allows the use of a larger bore 26 for the tieback string that will next to secured to bore 26 to make a connection to the surface with another metal to metal seal as illustrated schematically at 32 after the running tool that is not shown is pulled out of the hole. The use of a metal to metal seal 18 against the bore 26 provides only metal to metal seals from the liner attached at 10 to the surface while eliminating the use of elastomer o-rings or similar seals in a liner hanging application as described. The feature of moving the seal bore assembly 16 over the metal to metal seal assembly 18 allows fluid passages to remain open between them for running in to expedite that process.

In short, for operators that are hesitant to rely on elastomer seals between a mandrel and the polished bore 26 for what could turn out to be many years during the life of the well, the above described assembly presents only metal to metal seals from the liner string to the surface. Positioning the polished bore above the liner top packer also allows use of a larger polished bore for the tieback string to reduce flow restrictions during production.

Those skilled in the art will appreciate that the running tool is manipulated to extend dogs to bear on the assembly 16 indirectly for setting the liner hanger 12 in a known manner followed by a release of the running tool and the performance of the cementing job in a known manner. The liner top packer 14 is also set with pressure on a ball dropped into the running tool in a known manner.

The above description is illustrative of the preferred embodiment and many modifications may be made by those skilled in the art without departing from the invention whose scope is to be determined from the literal and equivalent scope of the claims below:

We claim:

1. A borehole liner string connection assembly for connection to a surrounding tubular, said borehole comprising a wellbore extending between a surface location at an upper end and a subterranean formation at a lower end, comprising:

a mandrel connected to the liner string at a lower end of said mandrel;

a liner hanger, liner top packer and metal to metal seal mounted sequentially to said mandrel in a direction away from said lower end, said mandrel remaining in the borehole with the liner string after setting said liner hanger;

a polished bore assembly selectively contacting said metal to metal seal;

said polished bore assembly is moveable into contact with said metal to metal seal after running in; and said liner top packer is set with tandem movement of said polished bore assembly with a setting sleeve.

2. The assembly of claim 1, wherein:

said metal to metal seal comprises a sleeve comprising a tubular body with spaced raised ends on said tubular body.

3. The assembly of claim 2, wherein:

said sleeve is threaded to said mandrel.

4. The assembly of claim 2, wherein:

said ends are a clearance or interference fit with said polished bore assembly.

5. The assembly of claim 1, wherein:

said polished bore assembly moves from a position above the metal to metal seal to a position over said metal to metal seal.

6. The assembly of claim 1, wherein:

said polished bore assembly has an inside dimension larger than an outside dimension of said mandrel.

7. The assembly of claim 1, further comprising:

a tieback string to a surface location further comprising another metal to metal seal to engage said polished bore assembly.

8. The assembly of claim 7, wherein:

said liner top packer comprises a metal to metal seal to the surrounding tubular.

9. The assembly of claim 8, wherein:

all the seals from the liner string to the surface are metal to metal seals.

10. The assembly of claim 1, wherein:

all the seals from the liner string to the surface are metal to metal seals.

11. A method of hanging a liner string to an existing tubular, comprising:

locating a metal to metal seal above a liner top packer internally on a mandrel supporting the liner string, said metal to metal seal comprising a sleeve having a tubular body with spaced raised ends on said tubular body;

moving a polished bore assembly to cover said metal to metal seal;

tying in a tieback string, extending to a surface location, to the polished bore assembly with a metal to metal seal;

flowing fluid between a subterranean formation and the surface location.

12. The method of claim 11, comprising:

moving said polished bore assembly over said metal to metal seal after running in said mandrel.

13. The method of claim 12, comprising:

setting a liner top packer on said mandrel with said movement of said polished bore assembly.

14. The method of claim 11, comprising:

providing another metal to metal seal as said liner top packer.

15. The method of claim 11, comprising:

providing only metal to metal seals between the liner string and the surface location.

16. A borehole liner string connection assembly for connection to a surrounding tubular, said borehole comprising a wellbore extending between a surface location at an upper end and a subterranean formation at a lower end, comprising:

a liner top packer for connecting and sealing to said surrounding tubular;

the liner top packer incorporating a metal to metal seal for connection of the liner top packer to a polished bore assembly above the liner top packer, said metal to metal seal comprising a sleeve having a tubular body with spaced raised ends on said tubular body; and wherein the liner top packer is set by movement of a setting sleeve of the polished bore assembly.

17. The borehole liner string connection assembly of claim 16 wherein:

the sleeve is secured to a mandrel of the liner top packer;

the sleeve receiving therein a lower end portion of the polished bore assembly.

18. The borehole liner string connection assembly of claim 17 wherein the polished bore assembly includes:

a first end portion to be received within the sleeve of the metal to metal seal; and a second end portion which is moved from an upper position to a position to cover the sleeve of the metal to metal seal and form a clearance or interference fit with the sleeve and the first end portion.

* * * * *